US007126055B1

(12) United States Patent
Low et al.

(10) Patent No.: US 7,126,055 B1
(45) Date of Patent: Oct. 24, 2006

(54) APPARATUS AND METHODS FOR DIELECTRIC BIAS SYSTEM

(76) Inventors: William E. Low, 7 Yorkshire, Newport Beach, CA (US) 92660; Richard Vandersteen, 2655 Sun Dr., Hanford, CA (US) 93230

( * ) Notice: Subject to any disclaimer, the term of this patent is extended or adjusted under 35 U.S.C. 154(b) by 0 days.

(21) Appl. No.: 10/699,710

(22) Filed: Nov. 3, 2003

(51) Int. Cl.
*H01B 11/02* (2006.01)

(52) U.S. Cl. ..... 174/33

(58) Field of Classification Search ..... 174/113 R, 174/36

See application file for complete search history.

(56) References Cited

U.S. PATENT DOCUMENTS 5,220,130 A * 6/1993 Walters ..... 174/36
5,307,416 A 4/1994 Martin
5,976,070 A * 11/1999 Ono et al. ..... 600/110
6,328,747 B1 * 12/2001 Nun ..... 606/107
6,448,500 B1 * 9/2002 Hosaka et al. ..... 174/113 R
6,495,763 B1 * 12/2002 Eichmann et al. ..... 174/113 R
2003/0132022 A1 * 7/2003 Williams et al. ..... 174/113 R

OTHER PUBLICATIONS

Mickelson, Marc, Music Interface Technologies Oracle v2.1 Interconnects and Speaker Cables, http://www.soundstage.com/revequip/mit_oracle_v21.htm, May 2003.

* cited by examiner

*Primary Examiner*—Chau N. Nguyen

(57) ABSTRACT

Methods and apparatus of connecting and communicating signals between electrical devices (such as stereo or video speaker or interconnect cables or similar circuits) include applying a bias voltage across the dielectric without interfering with the signals, by applying an energy source to at least one conductor not in the signal path.

27 Claims, 8 Drawing Sheets

APPARATUS AND METHODS FOR DIELECTRIC BIAS SYSTEM

FIELD OF INVENTION

The present invention relates generally to methods and apparatus of connecting and communicating signals between electrical devices. More particularly, the present invention relates to biasing a dielectric with an electrical or electrostatic potential to reduce undesirable electrical properties of the material such that signal quality between the electrical devices is enhanced. The invention has special utility within the field of audio and video equipment and signal transmission.

INCORPORATION BY REFERENCE

The contents of each U.S. patent or other reference, in any, cited in this application, are hereby incorporated by reference.

BACKGROUND OF INVENTION

The quality of electrical signal transmission is important and even critical in many aspects of modern life. Although the invention is discussed herein in special detail regarding audio and video signals, persons of ordinary skill in the art will understand that it has utility in a broad range of technologies and applications. Moreover, even though much of the discussion herein focuses on components of audio, and video (including, by way of example and not by way of limitation, speaker and interconnect cables), persons of ordinary skill in the art will understand that the invention can provide many benefits to many types of analog and digital signals.

For many individuals, technological innovations in audio and video signal generation, transmission, and reproduction have made the "home entertainment theater" video and/or audio systems the entertainment medium of choice. Those systems commonly include numerous separate electrical devices that need to transmit signals to and among each other. In addition to conventional "audio system" components (receivers, CD players, turntables, etc.), the visual experience has been enhanced with the advent of large screen televisions that include flat LCD and plasma screens. These entertainment packages are commonly coupled with multiple speakers for surround sound. The systems are sometimes integrated with computers and with speaker systems throughout the owner's home.

Independently of (or in addition to) the full "home theater" concept, audio systems designers strive to provide high quality sound to music aficionados. The dominant and common way that video and audio components are interconnected and communicate with each other is via cables. As such, one particular area of interest for system designers in enhancing audio/video reproduction is cable technology Enhanced cable technology facilitates signal communication between electrical components, which in turn results in appreciable improvement in the signal quality and resulting audio/video experience. In video systems, improved signal quality between electrical components may be observed in increased accuracy of video reproduction, thus video clarity is enhanced and the viewer's overall visual experience is enriched. In audio systems, improved signal quality between electrical components can reduce audio distortion heightening the overall fidelity of the music heard by the listener.

In other (non-video/audio) applications such as data communication (or indeed, any cable used to send electrical signals), the accuracy and reliability of signal transmission can similarly be improved by better cable technology. Persons of ordinary skill in the art will understand that this applies for both digital and analog signals.

Cable technology includes several aspects in which advances have been pursued, with varying degrees of success. These aspects include the materials used in the construction of cable elements and various arrangements of active and passive cable elements. Active elements include conductors used for signal transmission while passive elements may include dielectric/insulation materials specifically used to electrically isolated signal conductors, or metal to shield/protect the overall cable construction.

Other design and performance aspects include cable "run-in." Cable "run-in" refers to the process by which a cable eventually comes to a "steady" electrical state (including a relatively "stable" condition of the cable's dielectric material). The cable's transmission properties change as its dielectric material is exposed to various electrical charges. Similar to the charging of a capacitor, transmitting a desired signal over a cable can impose a potential across the cable's dielectric material that changes material properties of the dielectric. The process of "charging" the cable impacts the cable's transmission properties. However, once the cable is charged, it is in a relatively steady or stable electrical state.

Cable "run-in" is often mistakenly referred to as "break-in." However, "break-in" is more properly used to describe a mechanical change, e.g., engines, loudspeakers, and phono cartridge suspensions "break-in" during their initial periods of use. In contrast, cable "run-in" may be somewhat analogous to engine oil that warms during engine use to more efficiently and effectively protect the engine from damage cause by heat and/or friction. Just as that oil warming can reoccur every time that the engine is started, cable "run-in" (the gradual forming of the cable's transmission properties) can recur every time a signal is imposed on the cable.

In other words, and as indicated above, cables of this type may be thought of as long capacitors being gradually charged (i.e., "formed") by the electrical signal as the signal is communicated along a conductor surrounded by an insulating dielectric material. Most, if not all, conventional cables take some significant amount of time to "run-in" or optimize their performance characteristics through this dielectric biasing. By one estimate, it may take up to 300 hours of charging to establish an optimal (relatively steady) electrical field within a given cable. In addition, each time the audio or video signal is removed (i.e., an electrical device(s) is turned off), the electrical field in the cable dissipates and must be re-established when the electrical device(s) are turned back on (using the engine oil analogy, the oil must be warmed up each time the engine is started). In other words, the "run-in" process is repeated each time the source that created the "run-in" condition is removed and then reestablished.

As a consequence, the audio or video connoisseur may never (or may only very rarely) enjoy optimum sound quality using conventional cables, as the electric field is typically never fully established. Among other things, the home theater system may be turned off after a few hours or less of listening/viewing, precluding the cables from ever reaching an optimal "steady state." Even if the audio or video system is left in a stand-by mode, typically no signal propagation takes places through the cable, and once again, the electrical field collapses and the cables must be "run-in" again upon the next activation of the system.

Alternatively, the cable may be biased by a source other than the voltage varying electrical signal as that signal passes through the cable (see, for example, U.S. Pat. No. 5,307,416 to Martin). However, because that "other" biasing voltage is applied to conductors that are themselves in the electrical signal path, systems such as Martin's require the addition circuits such as digital gates, blocking capacitors, filtering devices and the like, to isolate the electrical devices' unbiased signal from the "other" biasing voltage. As such, Martin's approach introduces additional components that may increase manufacturing and/or consumer costs, and decrease system reliability.

Accordingly, there is a need for an improved system and method for biasing the dielectric of a cable connected between electrical devices, to eliminate the "run-in" problems mentioned above without the complications of a system such as described in the aforementioned Martin patent.

Other cables (such as Synergistic Research's Active Shielding) have shielding to reject external RF noise and use a blocking capacitor for "stronger" RF shielding. To the extent that such "active shielding" technology may provide some biasing of the cable dielectric as a by-product of its intended shielding purpose, it does so with shortcomings such as some of those in the aforementioned Martin patent—its "biasing circuit" is part of the signal path.

SUMMARY

[1] The present invention describes a system and method for biasing the dielectric of a cable connected between electrical devices. Among other things, the dielectric bias system (DBS™) of the invention provides biasing to maintain a desired "run-in" condition for the cable, without interfering with the signal itself. Establishing and maintaining a "run-in" dielectric bias potential enables the cable to more effectively, consistently, and immediately communicate a higher quality, lower distortion audio and/or video signal between electrical devices (as compared to a cable that is not pre-conditioned by the establishment of a dielectric bias potential).

In certain embodiments of the present invention, the biasing voltage is provided by an independent biasing "circuit" formed within the cable itself that is powered by a battery or other energy/biasing source independent of the desired cable signal. The battery or other biasing source can be conveniently mounted on the cable, and can be a standard size battery (for convenient and cost effective maintenance, etc.).

In other embodiments, the cable's dielectric can be biased without requiring complete isolation of the bias potential from the electrical devices' desired signal. In such embodiments, so long as the bias potential is applied to at least one conductor/contact that is not in the signal path, the bias potential is not a source of current in the audio or video signal path. In other words, the energy source can be connected to conductors which are in the signal path or which are connected to active "signal path" electronics. In such embodiments, there is no need for filtering because there is no current generated by the biasing/polarizing of the dielectric. This can result in a lower distortion of the signal and correspondingly increased signal quality between the electrical devices.

In addition, the present invention has general utility for electrical circuits where design considerations require a stored separation of potential or charge that may be used later in the circuit. Such electrical circuits may typically include signal or power supply filtering, or specialized circuits where a modification of the RC time constant by an independent bias potential may be needed.

The dielectric bias system of the invention preferably includes a means for communicating a signal between (a) a first electrical device having an output connection to supply the signal and (b) a second electrical device having an input connection to receive the signal. The communicating means includes a first conduction path for transmitting a desired signal; a dielectric material positioned along at least a portion of the first conduction path, and a means for impressing a bias potential on the dielectric material from an external source or a source independent of the desired signal. The means for impressing a bias potential can include a first contact and a second contact associated with the dielectric. The external source can be a battery or any suitable energy source.

The dielectric bias system may be used in many processes. Examples include the following steps: providing a dielectric bias system or cable as described herein; impressing the bias potential across the dielectric such that the bias potential is not a source of current in the signal path; supplying the desired voltage varying electrical signal between the electrical devices; removing the voltage varying electrical signal between the electrical devices; and allowing the bias potential to remain impressed (or otherwise maintaining the bias potential) across the dielectric.

The present invention thus provides apparatus, systems, and methods for creating a fixed stable field which electrostatically organizes (polarizes) the insulation in a way that is relatively simple to manufacture, assemble, and maintain.

DETAILED DESCRIPTION

Figure 1:
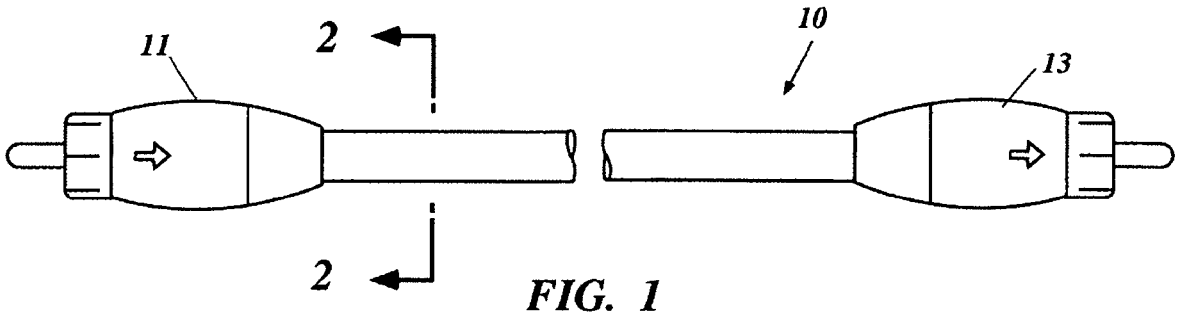
FIG. 1 Prior Art
FIG. 1 is a foreshortened plan view of a prior art cable used to communicate audio or video signals.

The present invention is directed to systems, apparatus, and related methods for improved electrical signal communication, such as cables connected between electrical devices, to speakers, etc. Among its many applications, the invention may be used in any cable capable of communicating electrical signals (including analog or digital, i.e., a voltage varying signal), between any type of electrical equipment/device.

The methods and apparatus can be used in any application in which a dielectric (such as an insulating material) would otherwise become "charged" by a signal or other transmission over an adjacent wire or circuit. Among other things, the invention "pre-biases" or "pre-charges" the dielectric, so that its properties (as well as those of the circuit or transmitting wire) are relatively unchanged by the application of signal or current across that wire or circuit.

The present invention may also be useful in electrical circuits where design considerations require a stored separation of potential or charge that may be used in the circuit. Such electrical circuits might typically include signal or power supply filtering network, or specialized circuits where a modification of an RC time constant by an independent bias potential is needed. The same principles and concepts discussed in detail herein regarding cables can be applied within such electrical circuits generally.

The apparatus of the invention can be fabricated from any materials that provide the benefits discussed herein. In its preferred embodiment, the present invention provides biasing of cable dielectric materials, as the invention is especially useful in systems and equipment for communicating analog and digital signals such as those used in audio and/or video equipment. For example, the invention can improve signal quality between the electrical components of a high-fidelity audio system, by reducing audio distortion and preserving the original sound qualities of the audio, thus heightening the overall purity of the music heard by the listener.

Thus, applications and materials for the invention include audio and video system communication cables. Cable construction and related principles are generally well known in the art, and will only briefly be discussed here. Similarly, RF shielding within cables and other cabling concepts are also well known in the prior art, and are not discussed in detail herein.

Broadly, wires and cables of those and other types typically provide low-resistance pathways or "conductors" for electric currents or signals. Most electrical wires are made from copper or silver, although any suitably conductive material may be used (aluminum, nickel, and steel are sometimes used, for example). Cables commonly include a number of wires bound together (along with other materials) to form a multiconductor transmission line. The wire elements can be arranged within the cable in a solid core, stranded, braided, or twisted geometry.

The wires typically are insulated from each other within the cable by an insulating coating of plastic, rubber, lacquer, or other dielectric material. The insulation materials do not conduct electricity or the signals themselves, but do have a dielectric property that causes them to absorb and release energy from the signal carried in the wire they are insulating. These insulation materials typically form the dielectric materials or elements discussed herein for cable embodiments of the invention, although other embodiments may use other materials and/or configurations of the materials and still benefit from the invention.

In general, the various components within a cable (including the materials selected, their sizes, and their arrangements within the cable) are determined by a number of factors, including the specifications of the relevant electrical devices with which the cable is to be used, basic electronic principles, manufacturing capabilities, environmental concerns, and regulatory agencies. These and other criteria can affect the selection of various cable elements. In many cables for which the present invention is useful, the elements to be selected include (by way of example) the conductor material, its length, its gauge or size, the type of insulation, shielding (to protect against RF or other interference with the signal), and the type of jacket surrounding the cable assembly.

Figure 2:
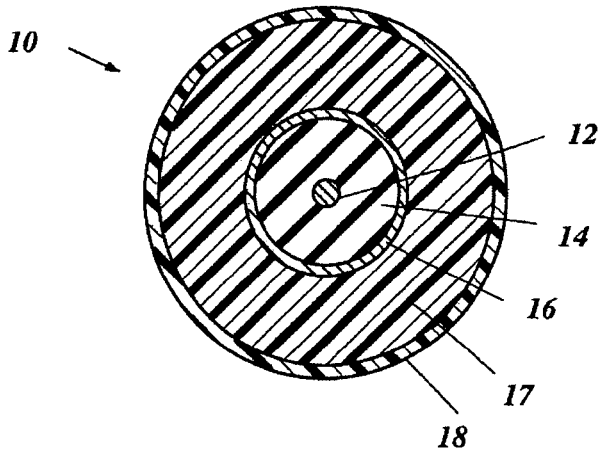
FIG. 2 Prior Art
FIG. 2 is a cross-section taken along line 2—2 of FIG. 1.

FIGS. 1 and 2 respectively show an example of a simple prior art cable 10 for transporting audio or video signals, and a cross section of the same. The cable's physical design is intended, among other things, to limit undesired inductive and capacitive effects and also limit external magnetic interference. The center conductor 12 may act as a "hot" lead. An insulating material 14 such as PVC, polyethylene, polypropylene or Teflon® (FEP), will typically encircle and isolate the center conductor 12 from a surrounding braided wire 16. The braided wire 16, or copper shielding, may act as the "cold" lead or ground lead, and also commonly both prevents radiation and signal loss of high frequencies used in electronic circuits, and reduces EMI/RFI interference. The braided wire 16 may itself be insulated, such as by insulation/dielectric 17. In addition, a cable jacket 18 (around the entire cable assembly) is typically added for strength, integrity, and overall protection of the components inside the jacket 18.

Such cables 10 typically include terminations 11 and 13 at each end, which commonly function as mating fasteners to join the wires and cable 10 with various electrical devices, other cables, or the like. The illustrations of terminations 11 and 13 in FIG. 1 are intended to be representative, and can include, among other things, a wide range of plugs, jacks, connectors, and adapters other than those shown in FIG. 1.

While there are many physical, electrical, and magnetic phenomena responsible for audio and/or video distortion in cables, a few basic mechanisms appear to account for the majority of performance variations between cables. One such electrical mechanism is the electrical state of a cable's dielectric component or components as an audio or video signal is communicated between electrical devices. In that regard, and as mentioned above, the insulation elements 14 and 17 in FIG. 2 typically act as dielectrics within the cable 10, as can the jacket 18.

As a consequence of those dielectric properties of the insulating materials, and as described above, audio cables (like most, if not all audio components) require an adjustment or "run-in" period. Cable "run-in" refers to the period of time or the dynamic electrical state or condition of the cable's dielectric during which it is approaching a "stable state". This is tantamount to the dielectric being "polarized" or charged (as a capacitor is charged in an electric circuit), by imposing a bias potential across the cable's dielectric material. If the signal is removed from a conventional cable (such as when the electrical devices generating the signal are turned off), the accumulated "charge" in the dielectric eventually dissipates, much as a capacitor's charge dissipates under certain conditions.

Cables of this type may thus be thought of as long capacitors being gradually charged by an electrical signal as the signal is communicated along a conductor surrounded by the dielectric material. Because of the way the dielectric typically behaves (gradually becoming "charged" to a stable state), and because that dielectric "charge state" impacts the overall transmission properties of the cable, a cable's performance is said to "form" during this charging process.

More specifically, absent the use of the invention discussed herein, as a signal is communicated along a cable (and as such signals are stopped or interrupted), the dielectric materials within the cable typically will absorb and release energy. Energy absorption can degrade a signal (part of the signal energy is being siphoned away), while energy released back into the cable (as the dielectric "discharges") may produce a phase shift in the audio frequency. The degree of detrimental affect a cable's dielectric may have on sound or video quality is typically reduced as the dielectric's performance/electrical characteristics are optimized (or at least approach a stable state) through the "forming" process.

In other words, current flowing through the cable's conductor (such as occurs with signal communication along the cable) imposes a bias potential across the dielectric, and causes the molecules in the dielectric to absorb energy and be rearranged from a relatively more random order into a relatively more uniform order. The cable's dielectric thus stores energy in much the same way as a capacitor (which typically consists of a dielectric material between two charged plates). Once the molecules are rearranged, the cable is said to be "run-in" or "formed", and remains in that relative steady state so long as bias continues to be applied across the dielectric. In prior art systems, that bias is only applied so long as current continues to flow through the conductor.

As explained herein, the preferred embodiment of the invention achieves that same desirable dielectric "steady state" within the cable, but without any actual current flowing. Perhaps more importantly, the invention maintains that steady state independently of the signal that may be transmitted through the cable or circuit periodically. In the preferred embodiment of the invention, instead of flowing current, a bias differential (preferably from a source other than the signal between the electrical components) is imposed across the dielectric elements of the cable. The bias preferably is applied either by conductor wires within the cable that are entirely independent of the cable's signal wires, or by apparatus that includes at least one such independent conductor wire.

Regardless of how the bias potential is imposed upon the dielectric materials (whether by prior art approaches or the present invention), the relative "charge" on those dielectric materials continues to change for relatively long periods of time (several weeks or more). The cable's transmission properties (and thereby the sound or picture signal quality) are affected by these changes in the dielectric state, during that same relatively long period of time. By one estimate, it may take up to 300 hours of charging to establish a stable electrical field within a cable. This phenomenon occurs whether the bias is imposed by the signal (such as in prior art systems) or by some source independent of the signal (as in the present invention).

This same phenomenon also occurs internally in many electronic devices other than in cables, including by way of example amplifiers, preamplifiers, and CD players. As a consequence, those devices similarly require an adjustment period in order to reach a relatively steady state electronically. As indicated above, hi-fi or stereo aficionados refer to this adjustment period as "run-in" for the cables, equipment, etc.

In prior art systems known by the inventor, "run-in" is a temporary condition that is recreated with each cycle of use of the cables/equipment. In other words, the cables/equipment undergo "run-in" when their dielectrics are biased by a signal or other source. If that signal or other source of biasing is removed (such as typically occurs in prior art systems when an electrical device is turned off), the "run-in" condition of the dielectric and the cable (or other equipment) dissipates and must be re-established the next time (and each time thereafter) that the biasing source is reapplied. It may take as long as several weeks of inactivity to return prior art cables to their original non biased state.

Thus, in prior art systems, the cables must be newly "run-in" each time the audio or video signal is turned off and then restarted. Unless a stereo is left running constantly, therefore, the cables commonly never fully form, and the listener's audio or video experience will be diminished (by the lower quality signal transmission, etc.) (the invention thereby allows "serious" listeners to enjoy a higher-quality listening experience without having to leave their systems running all the time, potentially saving energy and possibly extending the life of certain system components). Even if the audio or video system is left in a stand-by mode, signal typically is not propagated through the cable, which means that there is no biasing signal electrical field within the cable. The audio or video connoisseur thus may never enjoy optimum sound quality as the electric field within the cable is typically never fully established.

Thus, in almost all cables that do not include the present invention, the "run-in" condition must be re-established (the cable must be "re-formed") each time the electrical device is turned back on. The only exception of which the inventors are currently aware is the Martin '416 system discussed herein, which uses a different approach than the present invention. Martin's U.S. Pat. No. 5,307,416 (issued Apr. 26, 1994) describes a cable bias system intended to improve the accuracy of an electrical signal communicated between electrical devices. The system includes a bias voltage supplied across a first conductor (center conductor) and a second conductor (braided wire), similar to that shown in FIGS. 1 and 2 herein. However, because Martin's bias voltage is applied to conductors that are in the electrical signal path, Martin adds circuits (including digital gates, blocking capacitors, filtering devices and the like) to isolate the electrical devices' unbiased signal from the biasing voltage supplied by the voltage source. Thus, among other things, Martin's approach introduces additional components that may increase consumer costs in purchasing such cables and may decrease audio or video system reliability due to component failure.

In the present invention, by way of contrast, the biasing of the cable's dielectric can be accomplished by one or more completely separate pairs of wires within the cable, generally paralleling the signal wires in the cable. In alternative embodiments, at least one of the biasing wires (for the desired constant "biasing" of the dielectric) is independent of the signal wires (meaning that at least one of the biasing wires can also carry signal between the connected electrical devices).

The present invention thus overcomes the aforementioned problems of repetitive dielectric "forming" and "un-forming", and does so without requiring Martin's complex circuit design. As shown in the drawings (including FIGS. 3, 4, 8A, and 8B), the invention preferably comprises a dielectric bias system 20 that uses a separate energy source 22 (FIGS. 8A and 8B) such as a battery (preferably a conventional off-the-shelf model such as 21/23, AAA, 9-volt, 12-volt, or 24-volt, for example) to provide a virtually constant biasing potential on the dielectric.

The imposition of energy on the cable's dielectric thus preferably occurs even when the devices and cable are not in use and even when the cable is not connected to any components. In certain applications of the invention, the bias can even be applied far in advance of a consumer's purchase of the cable or other device, and the run-in or "forming" of the cable or device can occur completely before the consumer/user even connects the cable or device for the first time. The biasing will continue automatically even when the user turns off his audio/video system, so long as the battery or other biasing source continues. As mentioned above, and as explained further below, for embodiments using batteries, those presumably will need to be replaced periodically (although not too often, as there is no current being drawn from the batteries).

The invention preferably isolates its "constant" biasing source (such as one or more batteries) from the electrical devices' signal along the cable, thereby eliminating the need for complex filters and other devices as in Martin (see above). Preferably, this is accomplished by having at least one "constant biasing" conductor or wire within the cable that is not involved in the signal's circuit path.

Figures 8A, 8B:
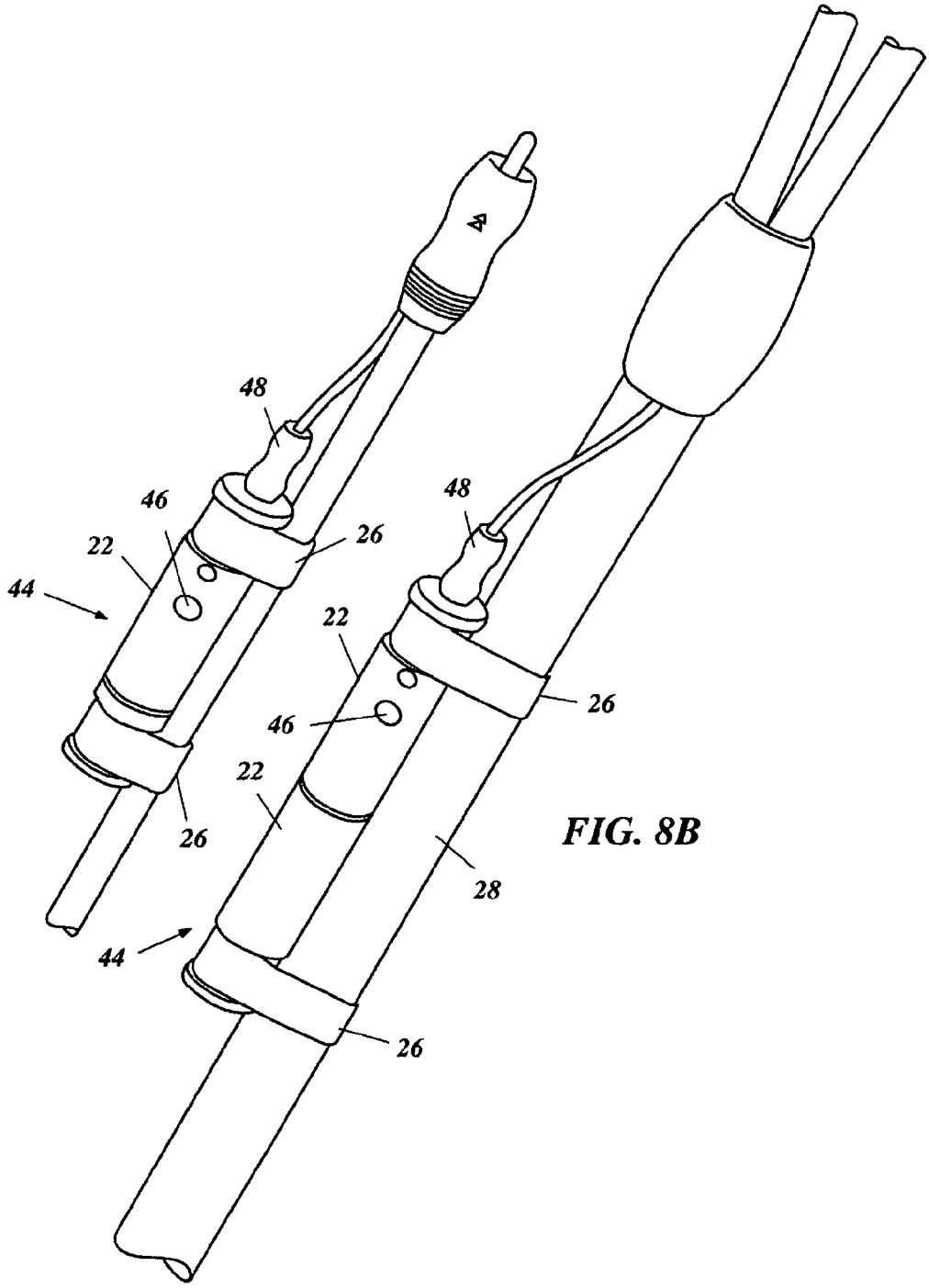
FIGS. 8A and 8B are perspective views of some of the many ways in which a bias impressing means or external energy source can be attached to or mounted on a cable embodiment in accordance with the present invention.

Preferably, the battery 22 can be readily connected to the cable 28 or disconnected from the cable 28, for purposes of battery replacement or the like. Such connectability can be provided in any suitable manner, including via a quick-connect adapter (such as element 24, FIG. 3) or by mounting the battery 22 or batteries to the cable 28 itself (see examples in FIGS. 8A and 8B, shown as clips or straps 26 holding a battery mounting means to the cable body 28). For embodiments of the invention using batteries 22, a plurality of batteries can be used (see FIG. 8B, which shows two batteries, as compared to FIG. 8A, showing one battery). As such, the batteries may be stacked together or strung in series along the length of the cable 28.

The cable 28 preferably includes connectors 30 at each end, configured to connect the cable 28 to an electrical device (not shown) such as a speaker, audio or video component, or the like. Persons of ordinary skill in the art will understand that the connectors 30 can be any suitable size and shape, and that the electrical device(s) to which the cable 28 is connected similarly can be any of a wide variety of devices.

In an audio system, for example, the invention can be used in cables 28 to connect any of the following together: receivers, preamplifiers, power amplifiers, equalizers, CD players, DVD players, record players, speakers, other cables (such as may be necessary to reach longer distances), or other electrical devices. For such connections, the cables 28 can be interconnect cables, speaker cables, or similar types of cable. Similarly, the invention may be used to communicate a video signal between suitable electrical devices such as a cable box, satellite dish, VCR, television, or DVD player. In short, benefits of the present invention may be realized, regardless of component arrangement, so long as the cable 28 is properly connected between two electrical devices (input of one device and output of the other device) that are designed to communicate an electrical signal with each other.

As described herein, the varying electrical signal may be an audio or video signal, such that may be communicated between high fidelity audio equipment or video components interconnected in a home entertainment theater. Basically, the dielectric bias system 20 of the present invention is useful (among other applications) in cables 28 that are used to propagate electrical signals such as analog or digital, between any type of electrical equipment.

Preferably, the communicating means or cable 28 includes a first conductor 32, typically a signal conductor defining the signal path. Signal conductors 32 of the type used in the present invention are well known in the art. Typically, in the context of audio or video transmission, a conductor such as copper or silver acts as the signal conductor 32 and functions as the hot lead. The signal path, defined by the signal conductor 32, communicates the electrical signal between the output of the first electrical device and the input of the second electrical device. In this regard, the term "communicates" describes the ability of a conductor to transmit and/or receive, i.e., propagate, an electrical signal.

As discussed above, the signal conductor 32 typically must be surrounded by an insulating/dielectric material 34, to prevent electrical shocks to users and/or electrical short circuiting generally. A dielectric material 34 such as PVC, polyethylene, polypropylene or Teflon® (FEP), will typically encircle or be associated in such a way as to electrically isolate the signal conductor 32 from other elements of the communicating means 28. Among other things, the insulating material or dielectric 34 separates the positive conductor or hot lead, typically the signal conductor 32, from the negative conductor or ground connect.

Figure 4:
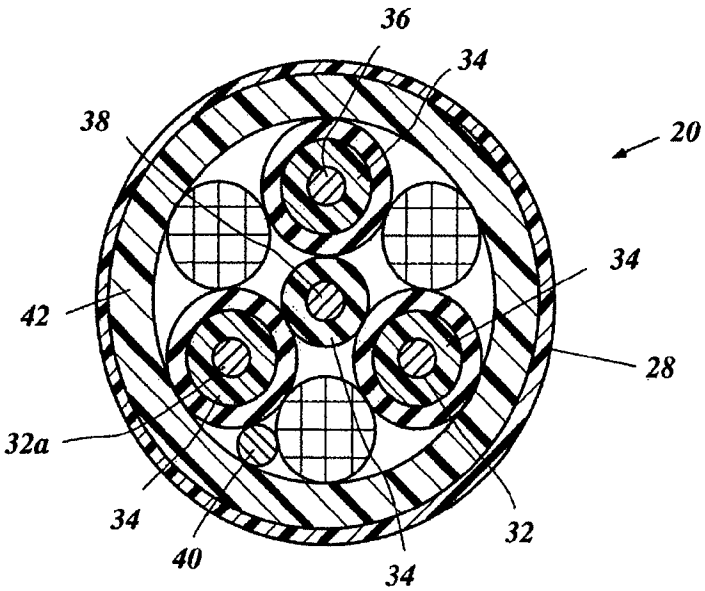
FIG. 4 is a cross-section taken along line 4—4 of FIG. 3.

The invention can be used for virtually any wiring arrangement within a cable. For example, in an unbalanced line such as an RCA jack, the signal may appear across the center pin while the shield or ground wire acts as the negative conductor or cold lead/ground lead 36. Some unbalanced interconnects have two signal conductors and a shield. In this arrangement the shield is typically not used as a signal conductor. In contrast, a balanced line terminated with XLR connectors, as shown in FIG. 4, will typically have three conductors, two carrying signal (first conductors) 32, 32*a* and one ground conductor 36 each conductor separated by dielectric material 34. The two signals in a balanced line are identical, but 180 degrees out of phase with each other. The ground conductor 36 is typically signal ground. Still other balanced interconnects use three conductors plus a shield.

Regardless of cable type or conductor configuration, dielectric material 34 of some type will typically separate or isolate the first conductor(s)/signal conductor(s) 32, 32*a* from other conducting elements (such as a second conductor 38 (power anode), third conductor 40 (drain or drainwire), and/or other conductors or elements comprising the cable 28). Thus, benefits of the invention can be realized, as described herein, to "pre-charge" or "run-in" the cable's dielectric materials, in whatever form or configuration they may take.

As indicated above and shown in the drawings, the communicating means 28 may further include a second conductor 38 and possibly a third 40, fourth, or more conductors. As will be appreciated by persons skilled in the art, configuration or arrangement of the first conductor 32, second conductor 38, third conductor 40, etc., (if supplied) and various other elements including dielectric 34 and shielding within a cable, may vary greatly depending on, among other things, the communicating means 28 construction (balanced, unbalanced, etc.), intended type of signal communication (audio or video), and electrical signal characteristic (analog or digital).

Figure 3:
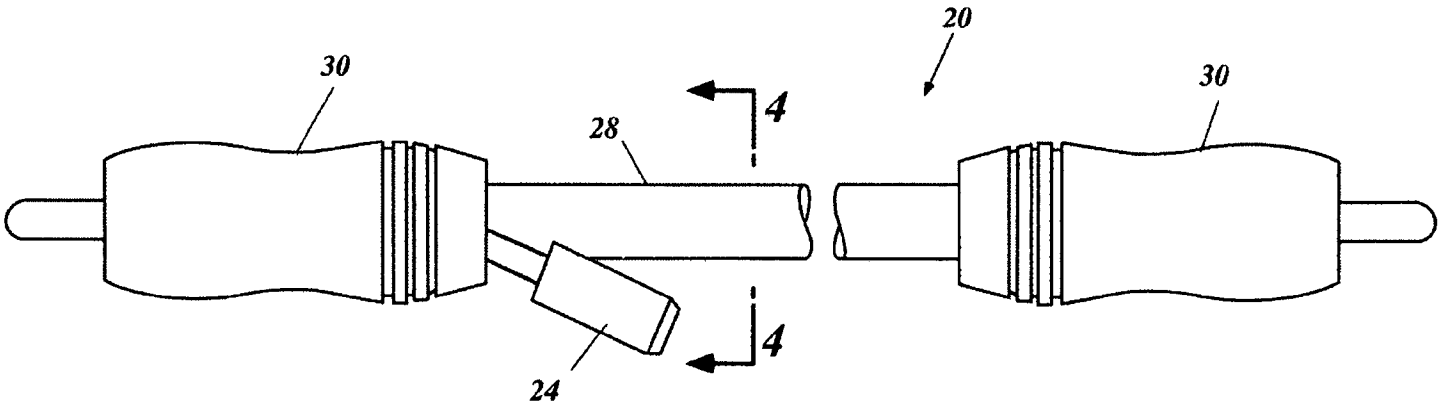
FIG. 3 is a plan view of one embodiment of a cable having a dielectric bias system of the present invention.

In FIGS. 3 and 4, the dielectric bias system 20 of the present invention is shown as it might be used in an audio cable, including a signal conductor(s) or first conductor(s) 32 that communicates the signal along a signal path between electrical devices. A second conductor 38, which may be a tinned copper wire used as a power anode, preferably is located near the center of the cable 28 and is separated from the first conductor by dielectric material 34. Alternatively, multiple power anodes may be utilized within a single cable, and relative positioning of such power anode(s) within the cable may vary depending on cable application and purpose.

A third conductor 40, FIG. 4, may be formed of silver plated copper wire, and may be used as a drain (sometimes referred to as a drainwire). Preferably, it is located adjacent shielding material 42 and is separated from the first conductor 32 and second conductor 38 by dielectric material 34. In this example, the second 38 and third conductors 40 preferably are also insulated and separated from various other electrical elements (including a non-inverting signal conductor 32, inverting signal conductor 32*a*, signal ground conductor 36, and RF shielding 42) by dielectric material 34. Consequently, in such embodiments, the dielectric 34 is associated with the first 32, second 38, and third conductors 40 such that when a bias potential is impressed across the dielectric 34, the bias potential is not a source of current in the signal path.

Figure 5:
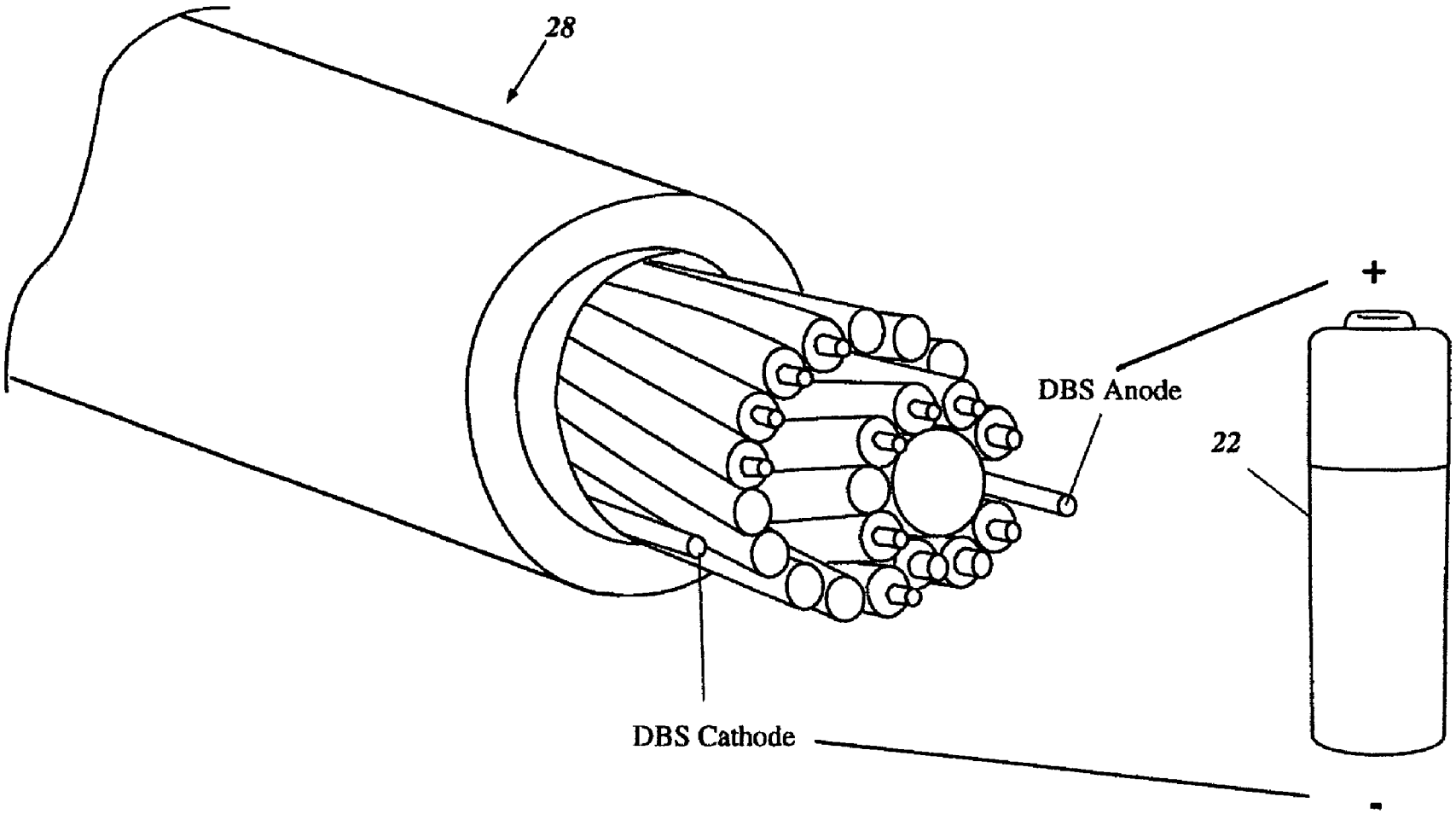
FIG. 5 illustrates an alternative visual representation of one embodiment of the cable elements and biasing connectivity of the present invention.

As indicated above, the relatively permanent or "virtually always on" bias potential of the invention can be supplied by batteries 22 or any other suitable source. Although the bias is preferably provided in some relatively "permanent" manner, alternative embodiments include providing the bias in any way that is independent of transmission of a signal along the signal-conducting wires. In the example of FIGS. 3 and 4, if a battery is used as the "relatively permanent biasing source", the battery terminals are connected by any suitable means to at least one of the wires that is not involved in transmitting the signal or varying voltage along the cable. FIG. 5, illustrates an alternative visual representation of the aforementioned cable elements and biasing connectivity.

Figure 6A:
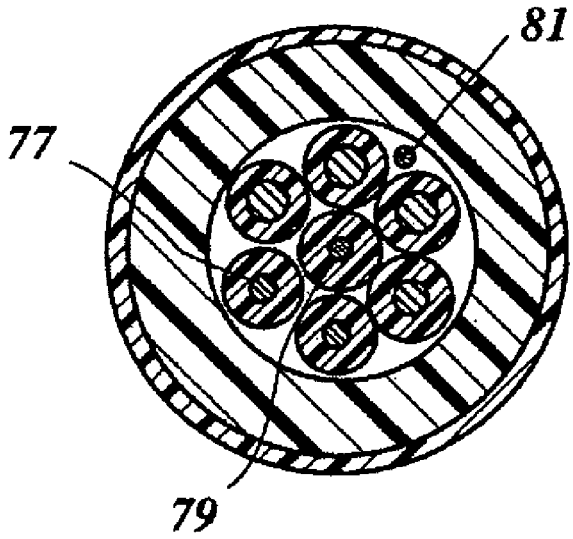
FIG. 6A is a cross-section of one of the many embodiments of the invention as it may be used in a speaker cable.

FIG. 6A illustrates another of the many embodiments of the invention, as it may be used in a speaker cable. Signal conductors such as wires 77 are insulated and positioned around a central biasing anode 79, which itself is preferably connected to the anode (positive terminal) of a 24V battery pack (not shown) or other biasing source. The cathode (negative terminal) of the battery pack preferably is connected to the combination drainwire/shield 81. The anode 79 preferably runs generally the length of the cable but terminates near the end or ends of the cable (rather than operatively connecting to complete a circuit), which means that no current is drawn from the battery 22. This is true whether the cathode 81 is "in the signal circuit" (as in FIG. 6A) or instead is a separate/additional wire that is not used in the signal circuit.

Figure 6B:
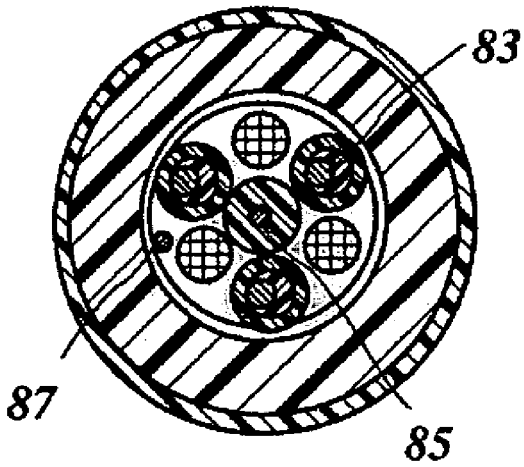
FIG. 6B is a cross-section of one of the many embodiments of the invention as it may be used in an interconnect cable (such as may be used between electrical devices).

FIG. 6B is a cross-section of still another of the many embodiments of the invention, as it may be used in an interconnect cable (such as may be used between electrical devices). One or more conductors (signal wires) 83 preferably are positioned about a biasing anode 85, and a cathode 87 includes a drainwire and foil shield surrounding the assembly. For this interconnect embodiment, the anode 85 and cathode 87 can be connected to a 12V battery pack, for example, or other biasing potential.

The biasing cathode/anode elements of the invention preferably extend substantially the length of the cable, in order to ensure that the "virtually constant" biasing effect of the battery or other source is applied along most, if not all, of the dielectric material in the cable. For embodiments in which the cathode is one of the signal-carrying conductors, it presumably would extend the complete length of the cable (in order to facilitate communication of the signal between the ends of the cable). Alternative embodiments could include, within a single cable, multiple biasing "circuits" spaced along the length of the cable and/or in parallel along the length of the cable. A preferred aim of any arrangement of the biasing apparatus within the cable would be to enable the cable to reach a "steady state" dielectrically based on the independent (non-signal) biasing, so that after reaching that steady state, transmitting signal along the cable would have little, if any, noticeable effect on the quality of the signal being transmitted (in other words, so that the cable would remain in a relatively consistent "run-in" state even if no signal were active on the cable).

Similar to the foregoing embodiments that can include multiple power anodes at various locations within the cable 28, multiple drains and/or cathodes may be incorporated into in a cable 28 at various positions to provide flexibility in cable design and function.

Figure 7:
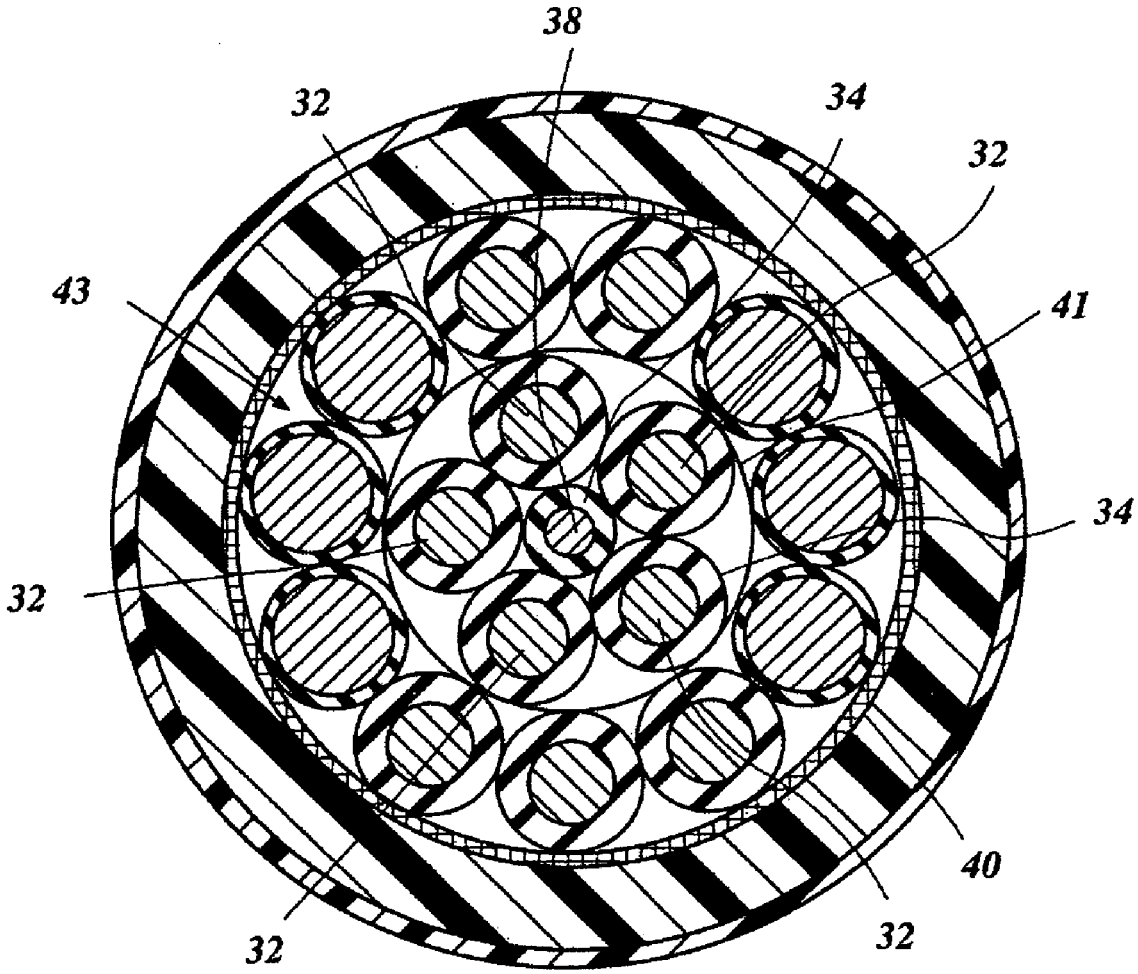
FIG. 7 is a cross-section of still another of the many alternative embodiments of the dielectric bias system in accordance with the present invention.

FIG. 7 illustrates another application of the invention as it might be embodied for a speaker cable. The cable's signal preferably is propagated along one or more first conductors 32 separately insulated and grouped in a substantially circular arrangement near the approximate center of the cable 28. The collection of wires 32 function to communicate a signal or signals along a signal path between electrical devices (not shown). The speaker cable preferably includes a second conductor 38 located near the center of the cable, which conductor 38 is surrounded by and separated from the first conductor(s) 32 bundle by insulating dielectric material 34. A third conductor 40 preferably is located near the outer edge of the cable, where it encircles other cable elements including the aforementioned first conductor 32 wire bundle and second conductor 38. In this example, the third conductor 40 may serve the dual role as an RF shield and as a contact point for receiving the bias potential impressing means (the battery voltage or other source of voltage). Similar to the previous examples, the first 32, second 38, and third conductors 40 are separated from each other and from other elements of the cable by dielectric material 34 (to avoid short-circuiting and signal crossover between them).

In addition, various other conductive and non-conductive elements such as those represented by a ring 43 of wires or cables positioned around the group of first conductors 32 may be included in the cable to provide cable stability, shielding, and/or facilitate the transmission and/or receiving of secondary signals independent of the signals discussed herein. For such embodiments, these additional elements should have little, if any, effect on the present invention (with the exceptions including if they have any dielectric properties that would be affected by the virtually constant biasing). Depending on the cable's intended purpose and related requirements, more or fewer of these additional elements may be included in a given cable, each having the same or a different material construction.

Accordingly, dielectric material 34 is associated with the first conductor 32 or signal conductor, the second conductor 38, and the third conductor 40, and the relatively permanent biasing means preferably is applied to any pair of the wires/conductors, so long as at least one of the relatively permanent biasing wires is not a source of current in the signal path. For example, in the embodiment of FIG. 7, the battery/biasing anode can be connected to conductor 38 (assuming that conductor 38 is not used in the signal path to the speaker), and the cathode can be the third conductor 40 (which also may serve as an RF shield for the signal wires, as indicated above). Alternatively, for embodiments such as FIG. 7 in which the third conductor/RF shield 40 functions as a signal ground, the anode/cathode of the battery/biasing potential impressing means 22 can be respectively connected to (a) one or more of the first conductor elements 32 and (b) the second conductor 38. For embodiments in which the second conductor 38 is used in the cable system as a signal ground, the biasing potential impressing means may instead be connected to (a) one or more of the first conductor elements 32 and (b) the third conductor 40, respectively. In another configuration, the second connector 38 or third connector 40 may function as signal ground and the biasing potential impressing means may be applied to those two aforementioned conductors 38, 40 while the signal is applied to the first conductor 32.

As indicated above, the dielectric bias system (DBS) 20 of the invention preferably includes an external bias potential impressing means 44 (FIGS. 8A and 8B) for impressing a bias potential, i.e., separation of charge, across the dielectric materials 34. The bias potential impressing means 44 may be any device capable of impressing a bias potential across a dielectric 34. For example, in one embodiment, the impressing means 44 of the present invention may be a DC battery power pack 22, which can include one (FIG. 8*a*) or more (FIG. 8B) batteries. In this example, the dielectric bias system battery pack 22 includes a high potential anode (typically designated "+" on battery terminals), and a relative low potential cathode (typically designated "–" on battery terminals). The anode and cathode of the battery pack 22 can be connected to the selected wires within the cable 28 by any convenient means, so that the stored energy/potential of the battery is impressed across the cable's dielectric materials 34. Other embodiments may include any of a wide range of suitable bias potential impressing means 44, including by way of example an AC/DC converter, a magnet, or similar devices. In the preferred embodiment, the bias potential impressing means 44 may provide a bias potential of 12 volts, or 24 volts, as those are conveniently and economically available in the form of replaceable and/or rechargeable batteries. However, depending on system requirements and anticipated loads and other factors, the amount of bias potential impressed across the dielectric 34 may be selected by the cable/system designer.

In this regard, voltage levels higher than 24 volts have been used to create a fixed stable field which electrostatically charges the insulation/dielectric with satisfactory results. As indicated previously, molecules of the dielectric organize when influenced by a current flowing through the cable's conductor, or as in the present invention separation, a separation of charge or polarization of the dielectric material. This rearranging of molecules from a relatively more random order to a relatively more uniform order conditions or forms the cable to facilitate communication of a higher quality audio or video signal.

In this regard, as the bias voltage increases above the signal voltage level, signal quality between electrical devices generally increases. For example, a dielectric bias voltage of 24 volts associated with a 1 volt audio signal will typically result in higher quality signal reproduction than a dielectric bias voltage of 12 volts associated with the same 1 volt audio signal. Likewise, a 48 volt dielectric voltage will generally result in higher quality signal reproduction than a 24 volt dielectric bias voltage associated with the same audio signal strength level.

As will be understood by those skilled in the art, the upper voltage is not intended to be limited to any specific voltage. However the use of any bias voltage may depend on various factors including: (1) the degree of signal transmission quality for any given difference in voltage between the dielectric and transmitted signal, (2) associated manufacturing and consumer costs, and (3) safety related issues regarding the use of various voltages.

Preferably, and as indicated above, the bias potential impressing means 44 such as battery pack 22 is connected to wires within the cable, so that those connected contacts or wires become, in effect, an extension of the battery's anode/cathode poles. For example, as shown in FIGS. 4 and 5, the high potential or positive (+) element of the bias potential impressing means 44 (FIG. 8) may be connected to the second conductor 38 in the center of the cable, and not to anything else. In such configurations, the relative low potential cathode of the power pack 22, typically designated (–), preferably is connected to the third conductor 40. In this way, a bias potential is impressed or established across the various dielectric materials 34 of the cable 28. However, since the dielectric 34 electrically insulates or isolates the first (signal) 32, second 38, and third conductors 40 from each other and because the battery/biasing means preferably is not itself part of any complete circuit, there is no current flow from the battery/bias potential through any of the conductors. As noted above, any such current can interfere with the signal transmission along the first conductor 32 or other parts of the cable, and would need to be filtered or otherwise resolved (such as by the more complex filters and other elements used in the aforementioned Martin approach).

The placement of the relatively permanent biasing wires within the cable preferably is such that all, or substantially all, of the dielectric materials are exposed to the bias potential and thereby "form" from the application of that bias potential. In other words, although FIG. 4 has just been described as preferably having the battery anode connected to center wire 38 and the battery cathode connected to a radially exterior wire 40, the precise position of the anode/cathode wires within the cable can vary widely and still achieve the desired beneficial "forming" effect.

As indicated above, depending on various factors including cable/interconnect construction (speaker or other type), intended application (audio/video signal transmission), and other factors (analog/digital signal), an RF shield in the cable or an outermost spiral of conductors may be used as the bias potential impressing means cathode (–). Some prior art cable designs and constructions do not include any such outer conductive layer, so a shield-like contact/conductor could be added to those designs, solely for use as a bias potential impressing means ground. Such a modification would be one way to readily adapt existing designs to incorporate the invention. Certain cables 28 can have dual-purpose outer contacts/conductors, which are able to serve simultaneously as a DBS cathode (–), and in their normally associated function as a shield or as negative conductors. An example of such a dual-purpose construction is illustrated in FIG. 7.

As indicated above, the biasing means or battery pack 22 preferably only functions to establish a bias potential across the dielectric 34, and there is no circuit to carry current between the anode and cathode of the battery pack 22. Therefore, generally speaking, there is little if any "drain" on the batteries (other than the initial "charging" or forming of the dielectric materials), and the battery pack 22 of the invention preferably will continue to operate virtually as long as a battery maintains its charge when it is simply stored on a shelf. Although the present invention may be described as having the anode and cathode connected to specific contacts/connectors, connection of the battery pack anode and cathode may be reversed on the various conductor configurations described herein (so long as there is no current/circuit flowing from the batter), or in any configuration utilizing the applicable principles of the present invention, while still enjoying the benefits of the DBS 20.

As indicated above, the DBS 20 may be beneficially utilized prior to connecting the ends 30 of the cable 28 to respective electrical devices. In such applications, the cable may be fully "formed" at the time that it is connected to electrical devices, and thereby a listener/viewer can have the immediate benefits of the invention without any "run-in" time. In other words, the cable run-in can occur early in the manufacturing/packaging process for the cable, rather than waiting until the end user opens the package. Additionally or alternatively, even if the relatively permanent biasing potential is not applied until the actual connection of the cable between electrical devices, the cable preferably will achieve its "formed" condition in relatively a rapid manner, and also preferably will maintain that "formed" condition even if the cable is disconnected, stored, or otherwise not used for some time (assuming, of course, that the biasing potential continues to be applied during the period of disconnection/non-use; simply keeping the battery 22 operatively assembled with the cable 28 would accomplish this purpose). Thus, the DBS 20 may continually place all of a cable's dielectric materials 34 into a comparatively high voltage DC field.

As shown in FIGS. 8A and 8B, the impressing means 44 will typically be connected external to the audio or video cable 28. Among other things, this preferably facilitates easy replacement of batteries (such as users might undertake at some regular time interval, such as yearly, to ensure that there always is sufficient biasing potential being applied to the cable's dielectrics). The impressing means 44 may be connected to the rest of the cable assembly by any suitable means, including bands, clamps, or similar connecting devices. Alternatively, in an embodiment not shown in the drawings, the impressing means 44 may be positioned such that a portion of the cable jacket or other similar material covers the impressing means 44 so that it appears that the impressing means 44 is housed within the cable assembly. Thus, the term "external" may be used to refer to (a) an electrical property of the impressing means 44 (not a source of current in the signal path), and/or to (b) the physical positioning of the impressing means 44 relative to the those elements of the cable 28 generally positioned within the cable's jacket. The impressing means 44 may alternatively include an LED or other indicator 46 to visually show the user that the impressing means 22 is connected properly and is impressing a bias potential across the cable's dielectric 34. Such a readout could alert users to replace the batteries or take other appropriate action.

Preferably, the bias potential impressing means 44 includes a means for coupling 48 the battery/bias potential from the external source (impressing means 44) across the cable's dielectric. In the embodiments of FIG. 3 (showing a quick disconnect 24), the impressing means 44 preferably includes some type of plug or wire connector that electrically connects the externally positioned bias potential impressing means 44 to wires that will impose the battery's bias across the cable's dielectric 34. In alternative embodiments, however, the bias impressing means 44 may be hard-wired directly to wires within the cable (without any quick-disconnect or other coupling means).

Figure 9:
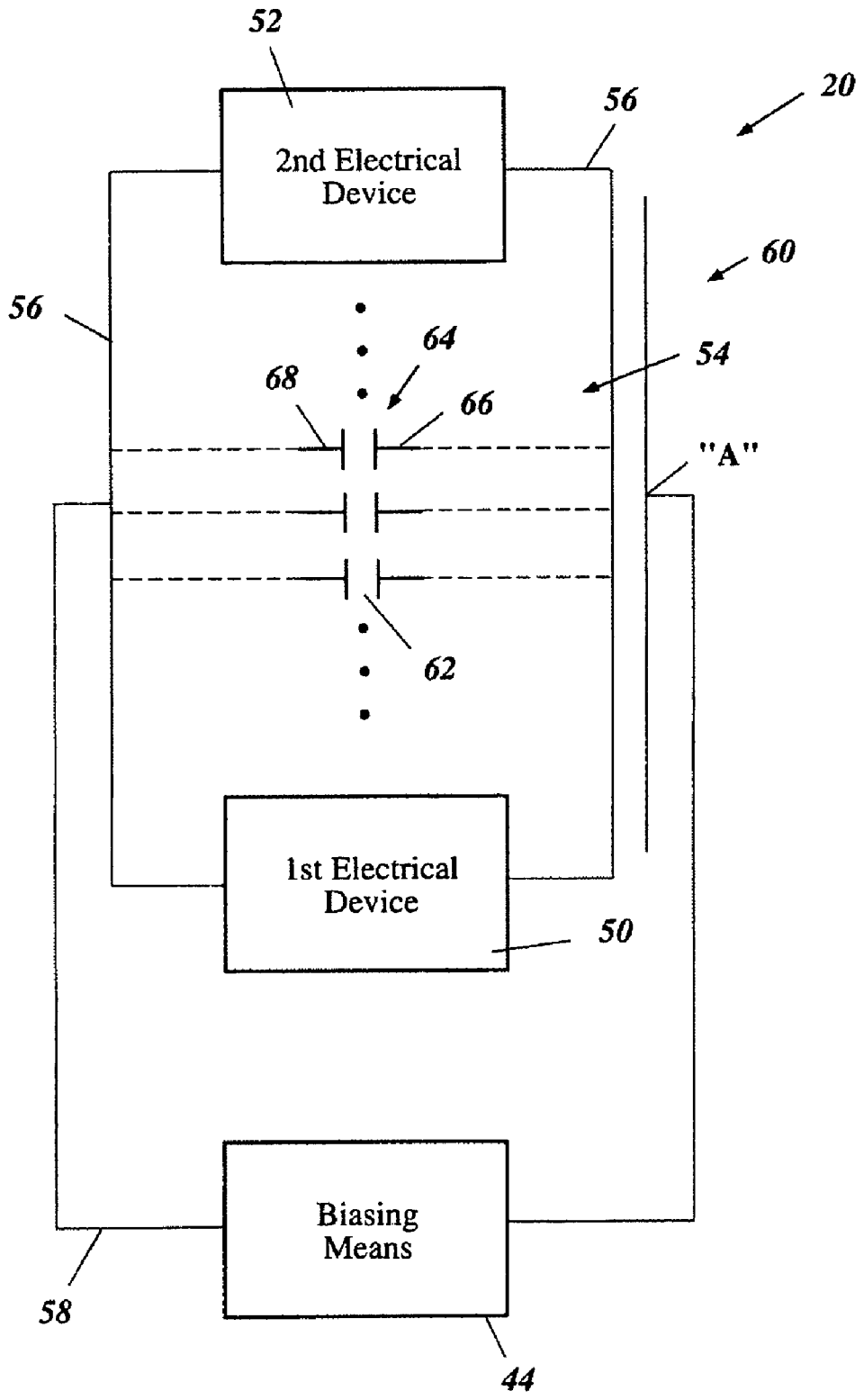
FIG. 9 is a circuit schematic of a dielectric bias system in accordance with the present invention.

FIG. 9 illustrates a circuit schematic representing one embodiment of a dielectric bias system 20 in accordance with the present invention. As shown there, the preferred configuration or arrangement of conductive elements of the present invention enables a bias potential to be impressed across dielectric materials without the bias potential being a source of current within the signal path. In other words, and as more fully explained below, the bias potential is applied to at least one conductor 60 that is not in the signal path.

As indicated above, a cable may be thought of as long capacitor, which is represented schematically by a series of capacitor symbols 64 in FIG. 9. As such, when a voltage is impressed across the cable's dielectric during the "forming" or "run-in" process, the dielectric materials in the cable effectively charge similar to a capacitor.

In addition to schematically representing a cable embodiment of the invention, FIG. 9 may also be representative of the present invention having general utility for electrical circuits where design considerations require a stored separation of potential or charge that may be used within the circuit. Such electrical circuits may typically include signal or power supply filtering networks, or specialized circuits where a modification of an RC time constant by an independent bias potential may be needed.

The dielectric bias system 20 of FIG. 9 preferably includes a means for communicating 54 a signal between a first electrical device 50 having an output connection to supply the signal, and a second electrical device 52 having an input connection to receive the signal. As described herein, the signal may be a voltage varying signal such as an analog or digital signal typically used in the communication of audio or video signals or other applications, or the signal may be a constant DC voltage that may be used to initiate or sustain operation of a particular circuit or device.

The communicating means 54 may be provided as or within a circuit board or ribbon, and can include various interconnects 56 to facilitate communication of the signal between electrical devices 50, 52 or between components of a single electrical device. For such embodiments, the interconnects 56 in FIG. 9 represent conduction paths within the communicating means 54 for communicating a signal between the electrical devices 50, 52. For example, the communicating means 54 may be a circuit board disposed within a radio, with various interconnects 56 or conduction paths such as solder runs functioning (by way of example) to electrically facilitate operation of the receiver, filtering circuit, modulation and/or demodulation networks, and/or to drive the speaker(s).

Among many other alternatives, the communicating means 54 may reside within a single electrical device. For example, the communicating means 54 may communicate a signal along a first conduction path 56 between a feedback network and an amplifying stage (which may only consist of a single transistor) in a radio receiver. In this example, the feedback network and amplifying stage may be considered as electrical devices connected by a first conduction path 56 that functions at least between the aforementioned components/devices. Thus, the term electrical device refers to any electrical entity or group of entities capable of functioning within an electrical circuit.

The communicating means 54 preferably further includes a means for receiving a bias potential from an external source. The bias potential receiving means preferably is associated with the first conduction path 56. This is illustrated in FIG. 9 by the biasing means 44 being received by or operatively connected to a conductor 60 at point "A" (which could be located at any convenient point along conductor 60) and along conduction path 56. Dielectric material 62 preferably is associated with the receiving means, and preferably is positioned adjacent and/or between the various parts of the conduction path 56. The dielectric material 62 is represented in FIG. 9 generally as the capacitor plate symbols in the center of the diagram. Embodiments such as FIG. 9 preferably also include a means for impressing 44 the bias potential across a selected portion of the receiving means, such that the bias potential is impressed across the dielectric 62. The bias potential impressing means 44 preferably is associated with a second conduction path 58 independent of the first conduction path 56.

As indicated in certain contexts herein, the term "associated" refers to a close proximity, connection, or relationship between elements such that a condition existing or imparted to one element in some way effects another element. Examples of such "associated" elements include a magnet affecting/moving iron filings that are in close proximity to the magnet without actually touching the filings; a current flowing through one wire inducing a current in another; and a capacitor charging when a switch is in a closed position, having no affect on a light bulb in the circuit until the capacitor is discharged when the same switch is an opened position, thus illuminating the bulb.

In embodiments such as illustrated in FIG. 9, the dielectric bias system 20 preferably further includes an external bias potential impressing means 44 associated with a second conduction path 58 for impresses a bias potential across a dielectric 62 associated with the first conduction path 56. As previously described herein, the bias potential impressing means 44 may be any device capable of impressing a bias potential across a dielectric material 62 to establish a separation of charge (also described as a bias potential). For example, as explained above, the impressing means 44 of the present invention may be a DC battery power pack 22. In the illustration of FIG. 9, the dielectric bias system battery pack 22 or other biasing potential preferably includes a high potential anode, designated (+), and a relative low potential cathode, designated (−), for impressing the bias potential across a dielectric 62 associated with the receiving means associated with the first conduction path 56.

FIG. 9 can also represent embodiments such as circuit boards that have actual physical capacitors formed in the circuit(s). In such embodiments, a receiving means such as a capacitor 64 preferably consists of a first contact 66 and a second contact 68 (separated by a dielectric 62), and preferably is associated with a first conduction path 56. The first conduction path 56 is connected between and capable of communicating a signal between a first electrical device 50 and a second electrical device 52. The first conduction path 56 is capable of communicating a signal between the aforementioned electrical devices independent of the second conduction path 58 represented by the biasing means 44 (and possible third, fourth, or other electrical devices, not shown). By way of example, the bias impressing means 44 may function within a timing circuit (not shown) to impress a bias potential (separation of charge) to a capacitor 64 that may be used continuously or at some later period in time within the circuit.

In such embodiments, the anode of the bias impressing means preferably is connected to a selected portion of either the first contact 66 or the second contact 68 (preferably conducting plates or like devices), and the bias impressing cathode is connected to a portion of the circuit board that functions as an "empty reservoir" such that as the bias potential of the bias impressing means is established across the dielectric of the capacitor, that bias potential is not a source of current in the first conduction path 56. In this regard, "a portion" refers to any part of the first or second contacts 66 or 68 that will effectively function to permit a potential (positive (+) or negative (−)), to be established across the first and second contacts 66 and 68. Further in this regard, the "empty reservoir" may be any selected portion of the communicating means (circuit board, ribbon, or the like device) that is separated from the first and second contact 66, 68 by dielectric material and is not in the first conduction signal path 56.

As will be apparent to those skilled in the art, the connections of the anode and cathode may be reversed on the circuit configuration just described for FIG. 9, while still enjoying the benefits of the present invention. Furthermore, as with biasing the dielectric of a cable, the bias potential associated with the second conduction path 58 preferably is not a source of current in the signal or first conduction path 56.

As indicated above, other bias potential impressing means may be utilized (for embodiments such as described in connection with FIG. 9 or otherwise), such as an AC/DC converter or similar devices. In many applications, the bias potential impressing means preferably will provide a bias potential of 12 volts or 24 volts. However, depending on system requirements and other factors, the impressing means may provide other bias potentials or energy across the dielectric.

Figure 10:
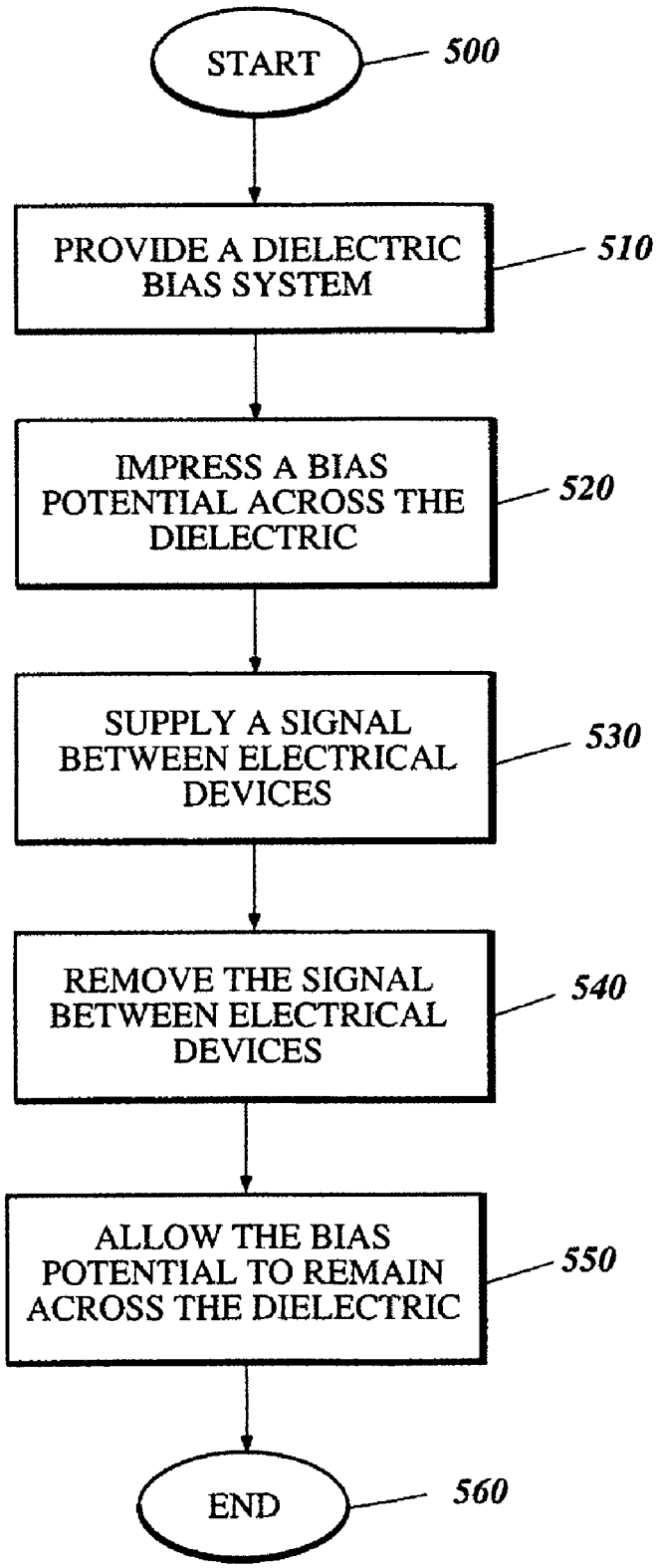
FIG. 10 is a flow chart illustrating a method of biasing a dielectric in accordance with the present invention.

Turning now to FIG. 10, a flow chart illustrates one of many methods of biasing a dielectric in accordance with the present invention. For convenience, the method described herein begins prior to supplying a voltage-varying signal between electrical devices. Alternatively, however, the method described herein may be utilized after the voltage varying signal is supplied between the electrical devices (although in such alternative embodiments, the steady state of the dielectric may not exist at the time the voltage varying signal initially is supplied). Furthermore, the continuation or interruption of step(s) once started (as well as the addition of other steps before, during or after those in FIG. 10) may depend upon the initial starting condition of the biasing system and the user's desired final condition or state of the biasing system. Therefore, although the method of the present invention is illustrated herein with steps occurring in a certain order, the specific order of the steps, or any continuation or interruption between steps, is not required.

The process begins at step 500. At step 510, a dielectric bias system as described herein is provided. A manufacturer, distributor, or other third party may supply the system/device. In this respect, "providing" the device is intended to refer to the fact that such a device is in fact present in use with the method, and so the device may be provided by the actual user thereof.

At step 520, a bias potential, as described herein, is impressed across the dielectric such that the bias potential is applied to at least one conductor/contact that is not in the signal path. As described herein, this may be accomplished in a variety of ways including impressing the bias potential across a selected portion of a receiving means such that the bias potential is established across the dielectric. In any case, impressing the bias potential across the dielectric preferably occurs so that the bias potential is not a source of current in the signal path.

At step 530, the voltage-varying signal is supplied between the electrical devices. In this regard, as described herein, the signal is communicated or propagated along a signal path between the electrical devices. At step 540, the voltage varying signal is removed from between the electrical devices, and at step 550, the bias potential is maintained (or allowed to remain impressed) across the dielectric. In this manner, the dielectric is "formed" such that signal quality between the electrical devices is enhanced. In the case of an electrical circuit, the dielectric is charged. The process ends at step 560.

While certain embodiments are illustrated in the drawings and described herein, including preferred embodiments, it will be apparent to those skilled in the art that the specific embodiments described herein may be modified without departing from the inventive concepts described. For example, though the process of the present invention is illustrated herein with steps occurring in certain order, the specific order of the steps, or any continuation or interruption between steps, is not required. For example, step 530, supplying the voltage varying between electrical devices may occur prior to step 520, impressing the bias potential across the dielectric. This is true whether the dielectric bias system is utilized in a cable or some other circuit. Accordingly, the invention described herein is not to be literally restricted by the claims that follow, except to the extent required by law.

What is claimed is:

1. A dielectric bias system for communicating a signal between (a) a first electrical device having an output connection to supply the signal and (b) a second electrical device having an input connection to receive the signal, the system comprising:

a first conduction path;

dielectric material positioned along said first conduction path such that transmission of a signal along said first conduction path tends to change the transmission properties of said first conduction path toward a relatively steady state as said dielectric material is exposed to said signal; and a means for impressing a bias potential across said dielectric material, the bias impressing means including at least one conductor which is not a conduction path for a signal between the first and second electrical devices.

2. The dielectric bias system of claim 1, in which said bias impressing means includes at least two conductors which are not conduction paths for signals between the first and second electrical devices.

3. The dielectric bias system of claim 1, wherein the signal is audio.

4. The dielectric bias system of claim 1, wherein the signal is video.

5. A dielectric bias system for communicating a signal between (a) a first electrical device having an output connection to supply the signal and (b) a second electrical device having an input connection to receive the signal, the system comprising:

a first conduction path;

dielectric material positioned along said first conduction path such that transmission of a signal along said first conduction path tends to change the transmission properties of said first conduction path toward a relatively steady state as said dielectric material is exposed to said signal; and a means for impressing a bias potential across said dielectric material, the bias impressing means including at least one conductor independent of the first conduction path, wherein the bias impressing means includes an external energy source.

6. The dielectric bias system of claim 5, wherein the external energy source is a battery.

7. A dielectric bias system for communicating a signal between (a) a first electrical device having an output connection to supply the signal and (b) a second electrical device having an input connection to receive the signal, the system comprising:

a first conduction path;

dielectric material positioned along said first conduction path such that transmission of a signal along said first conduction path tends to change the transmission properties of said first conduction path toward a relatively steady state as said dielectric material is exposed to said signal; and a means for impressing a bias potential across said dielectric material, the bias impressing means including at least one conductor independent of the first conduction path, wherein the bias potential impressing means is an AC/DC converter.

8. A dielectric bias system comprising:

a means for communicating a signal between a first electrical device having an output connection to supply the signal, and a second electrical device having an input connection to receive the signal, the communicating means comprising a first conduction path;

a means for receiving a bias potential, the receiving means associated with the first conduction path;

a dielectric associated with the receiving means; and a means for impressing the bias potential across a selected portion of the receiving means such that the bias potential is impressed across the dielectric, the bias potential impressing means associated with a second conductor that is not a conduction path for a signal between the first and second electrical devices.

9. A dielectric bias system comprising:

a means for communicating an electrical signal along a signal path connectable between a first electrical device having an output connection to supply the electrical signal, and a second electrical device having an input connection to receive the electrical signal, the communication means including;

a first conductor defining the signal path;

a dielectric associated with the first conductor; and a means for impressing a bias potential across the dielectric such that the bias potential is not a source of current in the signal path between the first and second electrical devices.

10. A system for communicating a voltage varying electrical signal along a signal path between electrical devices, including:

a first conductor defining a signal path for communicating the electrical signal;

a second conductor independent of the first conductor;

a dielectric associated with the first and second conductors; and an external energy source for electrically impressing a bias potential across the dielectric such that the bias is not a source of current in the signal path.

11. The system of claim 10, wherein the external energy source is a battery.

12. The system of claim 10, wherein the external energy source is an AC/DC converter.

13. The system of claim 10, wherein the signal is audio.

14. The system of claim 13, wherein the first and second conductors and dielectric are part of an audio cable, and said external energy source is mounted on said cable.

15. The system of claim 10, wherein the signal is video.

16. The system of claim 15, wherein the first and second conductors and dielectric are part of a video cable, and said external energy source is mounted on said cable.

17. A method of biasing a dielectric comprising the steps of:

providing a dielectric bias system having a means of communicating a voltage varying electrical signal along a signal path between electrical devices, the communicating means including a first conductor defining the signal path for communicating the electrical signal; a second conductor; a dielectric associated with the first conductor and the second conductor; an external source for impressing a bias across the dielectric;

impressing the bias potential across the dielectric such that the bias potential is not a source of current in the signal path;

supplying the voltage varying electrical signal between the electrical devices;

removing the voltage varying electrical signal between the electrical devices; and maintaining the bias potential impressed across the dielectric.

18. The method of claim 17, wherein the bias potential impressing mean is a battery.

19. The method of claim 17, wherein the signal is audio.

20. The method of claim 19, wherein the communicating means is an audio cable.

21. The method of claim 17, wherein the signal is video.

22. The method of claim 21, wherein the communicating means is a video cable.

23. A method of maintaining relatively steady electrical state within cables for stereo interconnects, including the steps of:

providing a cable having a first path for transmitting a signal across the cable, said cable including dielectric material positioned along at least some portion of the first path;

providing at least one conductor which is not a conduction path for a signal along the interconnect, said at least one conductor operatively positioned adjacent at least a portion of said dielectric material; and applying an energy source to said at least one conductor to impress a bias potential across the dielectric material.

24. A method of maintaining relatively steady electrical state within cables for stereo interconnects, including the steps of:

providing a cable having a first path for transmitting a signal across the cable, said cable including dielectric material positioned along at least some portion of the first path;

providing at least one conductor which is not in the first path, said at least one conductor operatively positioned adjacent at least a portion of said dielectric material; and applying an energy source to said at least one conductor to impress a bias potential across the dielectric material, in which said step of applying an energy source is accomplished by a battery operatively affixed to the cable.

25. A method of cable "run-in" for effectively turning a cable into a non-discharging capacitor, including the steps of:

providing a cable having a signal path and dielectric material associated with that path;

applying a bias potential to the dielectric material from an energy source other than the signal along a conductor which is not a conduction path for a signal between the first and second electrical devices; and maintaining that application of bias potential from said other energy source independent of the signal.

26. A dielectric bias system for communicating a signal between (a) a first electrical device having an output connection to supply the signal and (b) a second electrical device having an input connection to receive the signal, the system comprising;

a first conduction path;

dielectric material positioned along said first conduction path such that transmission of a signal along said first conduction path tends to change the transmission properties of said first conduction path toward a relatively steady state as said dielectric material is exposed to said signal; and a means for impressing a bias potential across said dielectric material, the bias impressing means including at least one conductor independent of the first conduction path, in which said bias impressing means includes at least two conductors independent of the first conduction path, wherein the bias impressing means includes an external energy source.

27. The dielectric bias system of claim 26, wherein the external energy source is a battery.

* * * * *